United States Patent [19]

Fryberger

[11] Patent Number: 4,580,865

[45] Date of Patent: Apr. 8, 1986

[54] MULTI-CONDUCTOR CABLE CONNECTOR

[75] Inventor: Charles T. Fryberger, Warren, N.J.

[73] Assignee: Thomas & Betts Corporation, Raritan, N.J.

[21] Appl. No.: 610,357

[22] Filed: May 15, 1984

[51] Int. Cl.[4] ..... H01R 13/58

[52] U.S. Cl. ..... 339/103 M; 339/89 M

[58] Field of Search ..... 339/103 R, 103 M, 103 B, 339/141, 89 R, 89 M, 90 R, 8 R, 8 P

[56] References Cited

U.S. PATENT DOCUMENTS

| | | | |
|---|---|---|---|
| 2,306,821 | 12/1942 | Markey | 173/328 |
| 2,355,166 | 8/1944 | Johanson | 174/77 |
| 2,824,290 | 2/1958 | Archer et al. | 339/49 |
| 2,954,542 | 9/1960 | Wales | 339/64 |
| 3,017,597 | 1/1962 | Nava et al. | 339/89 M X |
| 3,112,975 | 12/1963 | Homel | 339/89 |
| 3,585,564 | 6/1971 | Skjervoll | 339/8 |
| 3,649,956 | 3/1972 | Vrobel | 339/103 B |
| 3,920,304 | 11/1975 | Bromberg | 339/94 |
| 4,239,325 | 12/1980 | Tyson | 339/89 M |

*Primary Examiner*—Eugene F. Desmond

*Attorney, Agent, or Firm*—Robert M. Rodrick; Salvatore J. Abbruzzese

[57] ABSTRACT

An electrical connector for terminating a multi-conductor electrical cable. The connector includes a body portion having a central opening therethrough. A retainer is rotatably secured to said body and an insert is rotatably supported in said retainer. The retainer includes terminating means for supporting the terminated ends of the multi-conductor cable. The terminated conductors are rotatable with respect to the body upon rotation of the cable jacket.

12 Claims, 4 Drawing Figures

MULTI-CONDUCTOR CABLE CONNECTOR

FIELD OF THE INVENTION

This invention relates generally to an electrical connector for multi-conductor cable and more particularly to a connector which provides strain relief to the individual conductors of the cable.

BACKGROUND OF THE INVENTION

Electrical connectors have long been used to terminate and connect electrical cables having a plurality of insulated conductors in an outer insulative jacket. One use for such cable is to provide control signals to industrial and commercial machinery such as drill presses, lathes and the like. As these types of machinery rely upon the transmitted signals for proper functioning, the reliability of the connection between the signal source and the particular machine tool is essential.

Connectors typically used for such connections employ a multi-pin arrangement, where the individual electrical conductors are terminated with a pin-type terminal. The pins are then supported in pre-arranged and pre-configured openings in an insert. The insert is fixedly supported in one end of an elongate connector body. The opposite end of the connector body receives a sealing bushing and a gland nut to provide sealed termination of the cable.

As is typical with most sealing connectors, the sealing bushing is tightened around the cable jacket by attaching a gland nut to the end of the connector. Since the gland nut is screw-threaded progressively onto the connector, the frictional contact between the sealing bushing and the cable jacket has a tendency to twist the cable in the connector. This twisting motion of the cable within the connector may cause the individual conductors, held at the ends thereof in the insert, to helically twist. As the cable is held in fixed axial position in the connector by the sealing bushing and gland, one or more of the terminated pins may back out of the openings in the insert, making connection to that conductor unreliable. Thus the conductor would have to be re-terminated and the connection process begun anew.

While mechanical strain relief devices are known, which secure the terminated conductors in the insert, most are cumbersome to use and require additional parts and/or installation steps.

SUMMARY OF THE INVENTION

It is therefore an object of the present invention to provide an electrical cable connector for termination of individually terminated multi-conductor cable.

It is a further object of the present invention to provide an electrical connector which provides strain relief to the individual conductors of the cable.

These and other objects of the present invention are provided in an electrical connector having a rotatably mounted insert in a connector body. The insert retains and supports the terminated ends of the individual conductors of the multi-conductor cable. Rotation of the cable due to frictional engagement of the gland nut and sealing bushing with the jacket will cause rotation of the insert, thus preventing twisting of the conductors.

In a preferred embodiment, the connector includes a body having a cable receiving end, a conductor egressing end and a central bore therethrough. An insert retainer is rotatably supported in the body adjacent the conductor egressing end and an insert is rotatably supported in the insert retainer. A cable gland is secured to the cable receiving end, with a sealing bushing placed therein between.

DETAILED DESCRIPTION OF THE PREFERRED EMBODIMENT

Figure 1:
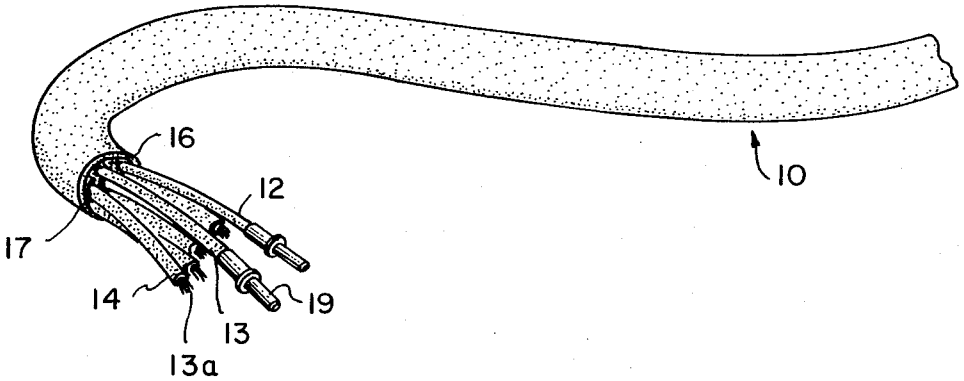
FIG. 1 shows an end extent of a multi-conductor cable for use with the connector of the present invention.

Referring to FIG. 1, an end extent of a conventional electrical cable 10 is shown. Cable 10 includes a plurality of insulated conductors 12, each having an inner stranded conductive core 13 surrounded by insulation 14. An outer insulative jacket 16 surrounds the plural conductors 12. A fiberous filler 17 is interposed among the conductors 12, within jacket 16. Filler 17 supports the individual conductors 12 in relatively fixed position in cable jacket 16.

In order to prepare cable 10 for use with the present invention, the cable jacket 16 is stripped away at an end portion of the cable 10. The filler 17 is also cut away around the exposed conductors 12. Each of conductors 12 is then individually stripped of the insulation 14 at ends 13*a* thereof. A pin-type electrical terminal 19 is placed on each of the ends 13*a* of conductors 12. The terminals 19 are conventionally crimped or otherwise secured to conductors 12 to provide suitable electrical connection capability. Terminals 19 are of conventional construction and can be of the pin-insertion or pin-socket type. Examples of such terminals are shown and described in U.S. Pat. Nos. 3,242,456 issued Mar. 22, 1966 and 3,311,866 issued Mar. 28, 1967.

Figure 3:
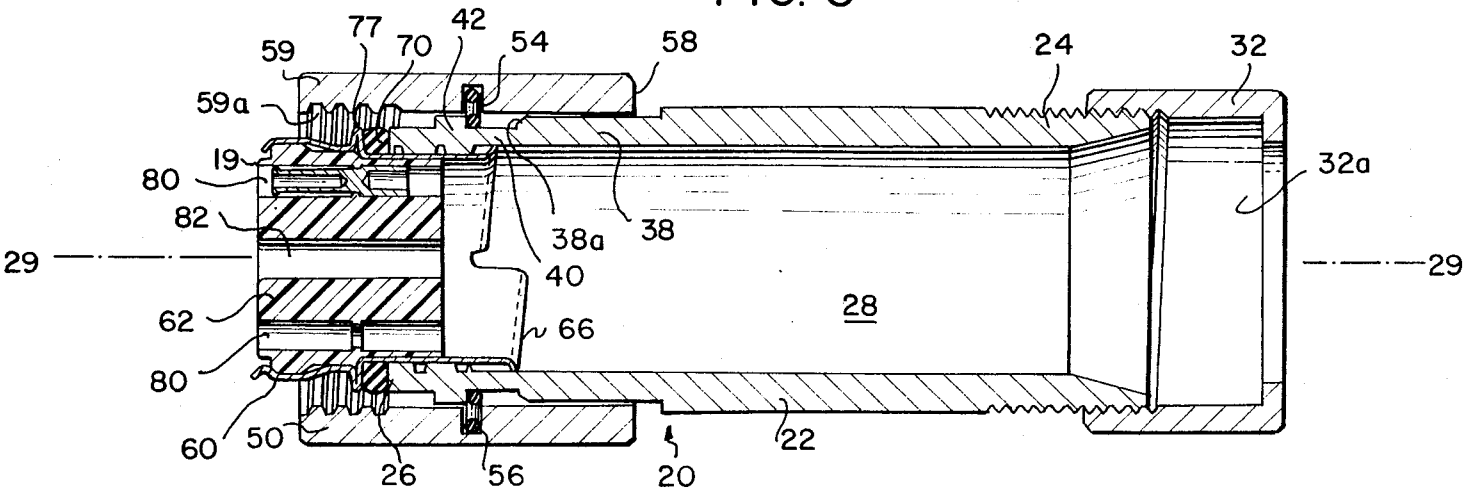
FIG. 3 is a vertical section of the assembled cable connector of FIG. 2.
Figure 2:
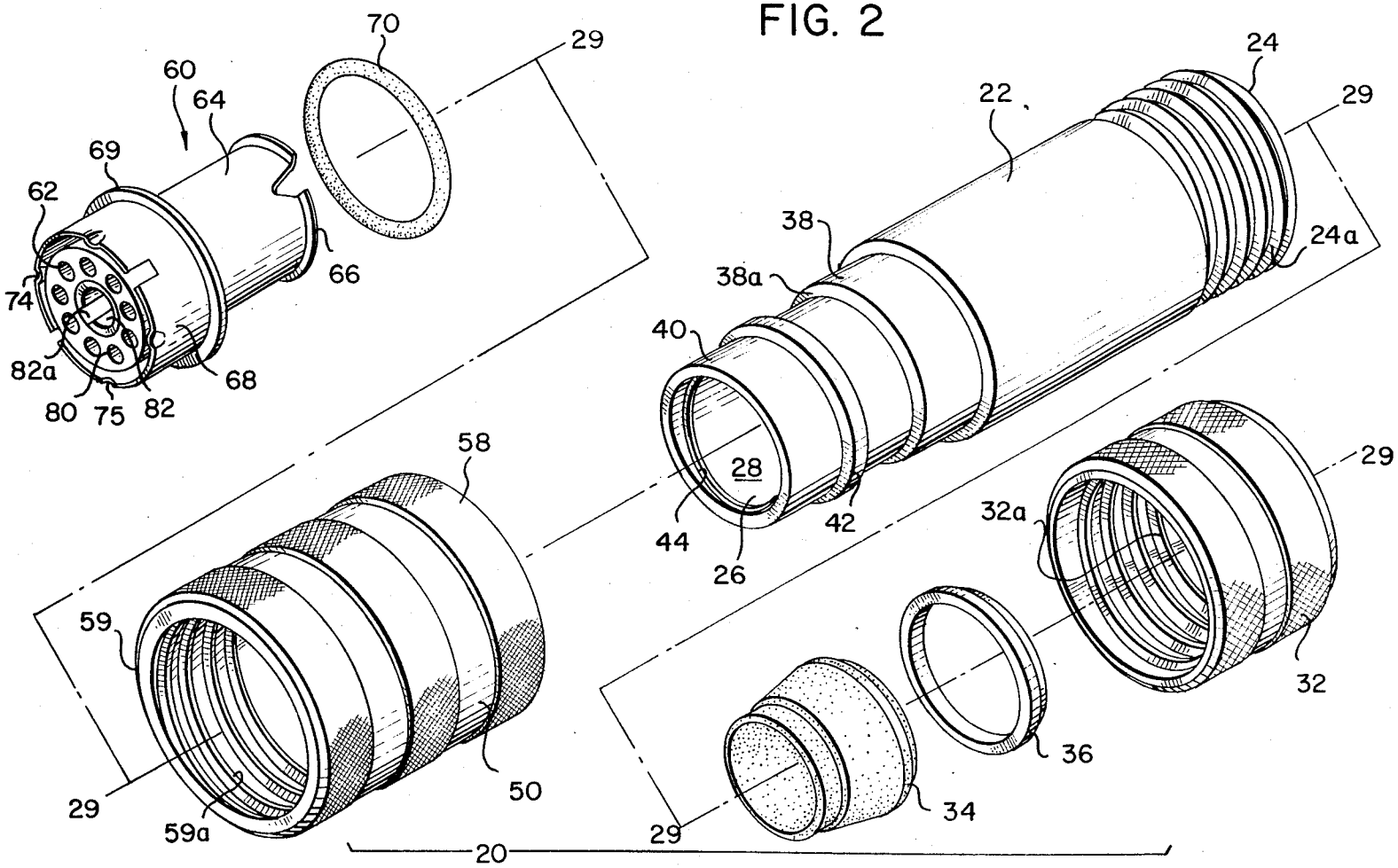
FIG. 2 shows in exploded perspective view, the cable connector of the present invention.

Referring now to FIGS. 2 and 3, connector 20 is shown comprising an elongate hollow, generally cylindrical body 22, having a cable receiving end 24, a conductor egressing end 26 and a central bore 28 extending therethrough along central longitudinal axis 29. The cable receiving end 24 has an externally screw-threaded portion 24*a*. A complementary internally screw-threaded cable gland 32, having a cable passage 32*a* along axis 29, is attached to the cable receiving end 24 of body 32. A frusto-conical resilient sealing bushing 34 and sealing ring 36 (FIG. 2) are interposed between cable gland 32 and body 22. The attachment of cable gland 32, sealing bushing 34 and annular sealing ring 36 is accomplished in conventional fashion to provide sealed termination of cable 10 in connector 20, as will be described in greater detail hereinafter.

Adjacent conductor egressing end 26, body 22 includes a first stepped-down portion 38 and a second stepped-down portion 40, immediately adjacent conductor egressing end 26. An annular rib 42 extends radially outwardly from the surface of body 22 at second stepped-down portion 40. The inner portion of conductor egressing end 26 includes a single helical thread 44. Each of these above-mentioned elements will be described in further detail hereinbelow.

A connector gland 50 is attachable to the conductor egressing end 26 of body 22. Connector gland 50 is a hollow cylindrical member having a central bore 52 therethrough, co-axially aligned with central bore 28 of body 22, as shown assembled in FIG. 3. Connector gland 50 includes a centrally located internal annular groove 54 (FIG. 3), which accommodates therein retaining wire form 56. Wire form 56 is a spring-type coiled metallic ring which can be radially expanded and when released will return to its former contracted condition. As the connector gland 50 is inserted over the conductor egressing end 26 of body 22, the wire form 56 will expand to pass over annular rib 42. Once beyond the extending annular rib 42, the wire form 56 will snap back to its contracted position against the second stepped-down portion 40 of the body 22. In this position (shown in FIG. 3) the wire form 56 is captivated between annular rib 42 and shoulder 38*a* of first stepped-down portion 38. It is contemplated that a suitable installing tool (not shown) may be employed to attach the connector gland 50 to body 22. The installing tool would provide for expansion of wire form 56 so that it may clear annular rib 42. Once clear of rib 42, the tool can be removed. As shown in FIG. 3, the connector gland 50 is rotatably supported on body 22, with the rear portion 58 (the right end of connector gland 50 as shown in FIG. 3) accommodated in the first stepped-down portion 38 of body 22. A forward portion 59 (opposite rear portion 58) of gland 50 includes an internally screw-threaded portion 59*a* for screw-attachment to an electrical apparatus or another cable connector to which connection is desired.

The conductor egressing end 26 of body 22 further receives a conductor insert retainer 60 and insulative insert 62 which are shown preassembled in FIGS. 2 and 3. Insert retainer 60 is a generally hollow, cylindrical member formed of steel or similar metal. The retainer 60 includes a narrow rear section 64, having a single helical thread 66 for mating connection with the thread 44 of body 22. The retainer 60 further includes a wider forward section 68 for captive receipt of insert 62.

As previously described, body 22 includes a single internal helical thread 44, adjacent conductor egressing end 26. The rear section 64 of retainer 60 is screw-inserted into body 22 at conductor egressing end 26. Once the single helical thread 66 of retainer 60 passes the single thread 44 of body 22, the retainer 60 is captively, but freely rotatably secured in body 22. As will be described in further detail hereinbelow, this rotative securement provides strain relief to the conductors 12 supported in connector 20.

At the junction of narrow rear section 64 and wider forward section 68 is a radially outwardly extending collar 69. Collar 69 supports a resilient O-ring 70 for position between collar 69 and the conductor egressing end 26 of body 22 (FIG. 3). O-ring 70 provides a seal between the insert retainer 60 and body 22 upon assembly of connector 20.

Insertable into retainer 60 is insert 62, which supports the ends 13*a* conductors 12 (not shown in FIG. 3). Insert 62 is an insulative member formed of a suitable plastic material and is generally cylindrical in shape, having an outer diameter which closely approximates the inner diameter of retainer 60. Thus, insert 62 may be slide-fit or otherwise suitably supported in retainer 60. The forward lip 74 of retainer 60 is crimped at circumferentially spaced locations 75 to support insert 62 in retainer 60 and prevent forward removal. A shoulder 77, at the central portion of insert 62, which serves as a stop surface, abuts against the inner portion of collar 69, preventing rearward withdrawal of insert 62. Since the insert 62 is confined only in the axial direction in retainer 60, the insert 62 is freely rotatable within retainer 60.

Insert 62 further includes a plurality of axially extending elongate bores 80 therethrough. Bores 80 are arranged in a circular pattern around the perimeter of insert 62. Each bore 80 accommodates therein, one terminal 19 attached to a conductor 12 of cable 10 for electrical connection to mating terminals of a further connector or other apparatus to which connection is desired (not shown). A central channel 82, extending along the axis 29, through insert 62, provides for mechanical alignment of the insert 62 with a mating extending pin of the other connector or apparatus. Channel 82 may include a polarization device 82*a* to assure proper orientation of insert 62 and thus effect proper positional alignment of terminals 19.

Figure 4:
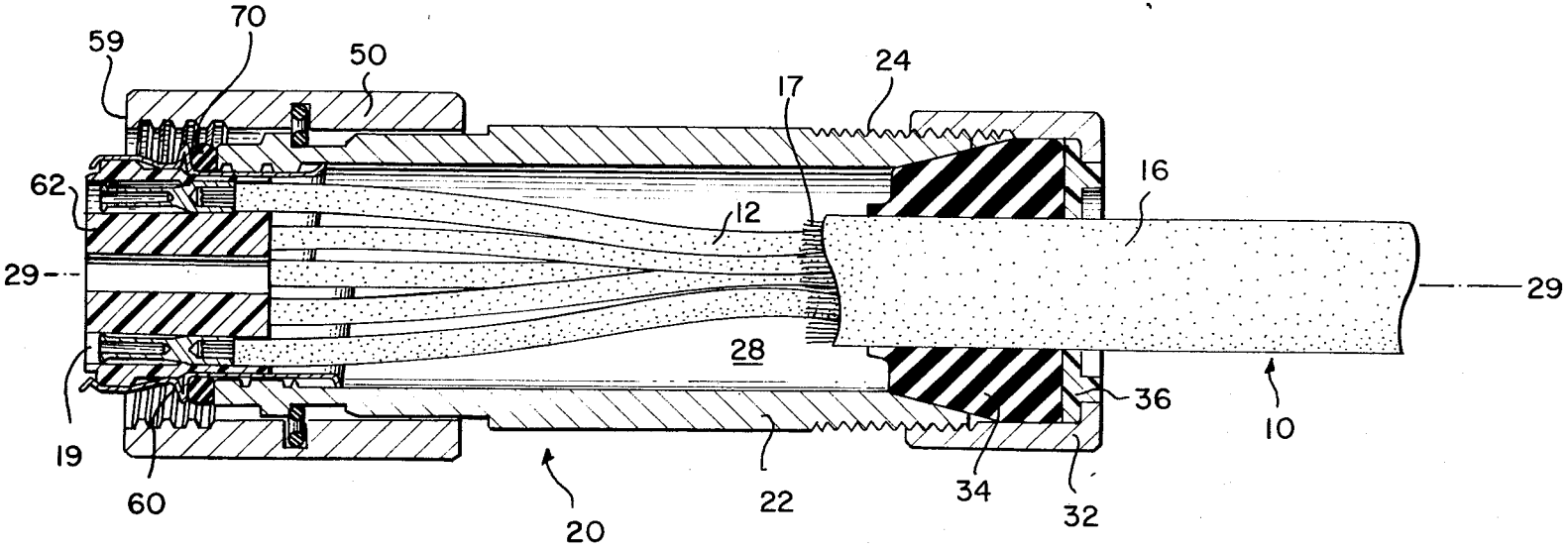
FIG. 4 shows the cable connector of FIG. 3, with the cable inserted therein.

Referring now to FIG. 4, the termination of cable 10 in connector 20 may be described. The cable 10 is prepared as above-described with the jacket 16 stripped partially away. The ends 13*a* of conductor 12 are terminated with terminals 19. The cable gland 32 is placed on the cable 10 over jacket 16. Similarly, sealing ring 36 and sealing bushing 34 are next placed over jacket 16. The body 22, with body gland 50 pre-assembled thereto as above-described, is placed over jacket 16. The body 22, with body gland 50 is pushed down along jacket 16 to provide a working length of terminated conductors 12 extending beyond the forward end 59 of body gland 50. The terminals 19 of the conductors 12 are placed individually into the bores 80 of insert 62 and are conventionally secured therein. The insert 62 is preassembled in retainer 60 with O-ring 70 positioned at collar 69. The body 22 is then brought up to the insert retainer 60, which is screw-threaded into body 22 in the position shown in FIG. 4. As above-mentioned, the insert 62 is rotatably supported in retainer 60, and the retainer 60 is itself rotatably supported in body 22.

The cable gland 32 is then brought up to the cable receiving end 24 of body 22 with the sealing bushing 34 and sealing ring 36 disposed thereinbetween. The cable gland 32 is then screw attached to the cable receiving end 24 of body 22 in conventional fashion. As the cable gland 32 is tightened onto body 22, the sealing bushing 32 will frictionally engage the cable jacket 16. The frusto-conical shape of bushing 34, will force the bushing 34 further into body 22 until the bushing provides a sealed engagement between the jacket 16 and body 22. However, upon screw attachment of cable gland 32 to body 22, the frictional engagement of bushing 34 with jacket 16 may cause cable 10 to rotate in the direction of screw rotation of cable gland 32. As the conductors 12 are fixedly positioned in jacket 16 by filler 17, the conductors will also rotate within body 22. As previously mentioned, if insert 62 was conventionally, non-rotatably supported in body 22, the terminals 19, at the ends 13*a* of conductors 12, would have a tendency to pull out of insert 62 upon twisting, as the cable jacket 16 is axially positionally confined by bushing 34. The present invention provides a "double-free float mechanism" preventing such twisting of the conductors 12. Upon rotation of jacket 16 and conductors 12 of the cable 10, the insert retainer 60, including insert 62 will rotate, thus preventing twisting of conductors 12 and pull out of terminals 19 from insert 62.

The double-free float feature provides a fail-safe mechanism. If the insert 62 is inadvertently pressed into non-rotative securement in retainer 60, the rotation of retainer 60 in body 22 will provide for the rotation of conductors 12 in body 22. Similarly, if the retainer fails to rotate in body 22, the rotative support of insert 62 in retainer 60 will provide the needed rotational movement thus preventing twisting of conductor 12.

Various other changes to the foregoing, specifically disclosed embodiments and practices will be evident to those skilled in the art. Accordingly, the foregoing preferred embodiments are intended in an illustrative and not in a limiting sense. The scope of the invention is set forth in the following claims.

I claim:

1. An electrical connector for terminating an electrical cable having a plurality of wires extending therein, said connector comprising:

a body having a cable accommodating end, a wire egressing end and a central bore therethrough;

means supported on said body for providing connection to an electrical device;

a support member rotatably supported in said central bore of said body adjacent said wire egressing end;

terminating means for accommodating said wires for connection to said electrical device, said terminating means being rotatably supported in said support member for rotation independent of said rotation of said support member in said body; and sealing means for sealably accommodating said cable in said body.

2. A connector of claim 1 wherein said body is elongate and said central bore extends axially therethrough.

3. A connector of claim 2 wherein said connection means comprises a body gland rotatably supported at said wire egressing end of said body, said body gland including means for providing securement of said body to said electrical device.

4. A connector of claim 2 wherein said support member includes a central opening therethrough, said central opening being co-axial with the central bore of said body.

5. A connector of claim 2 wherein said terminating means is supported in said central opening of said support member.

6. A connector of claim 5 wherein said terminating means comprises an insert having a plurality of channels therethrough, each of said channels corresponding to one of said plural wires, said channels extending in axial alignment with said central opening of said support member.

7. A connector of claim 6 further including contact terminals for terminating each of said wires of said cable, said terminals adapted for receipt in said channels of said insert.

8. A connector of claim 7 wherein said sealing means comprises:

a screw threaded cable gland attachable to the cable accommodating end of said body; and a sealing bushing disposed between said cable gland and said body for frictional engagement with said cable.

9. An electrical termination device for electrical cable having an outer insulative jacket and a plurality of individually insulated conductors extending therethrough, said termination device comprising:

an elongate hollow cylindrical body having a jacket accommodating end and a conductor egressing end;

a body gland rotatably secured to said body at said conductor egressing end, said body gland including means thereon for connecting said device to an electrical apparatus;

sealing means for providing sealed engagement of said cable to said body; and conductor receiving means rotatably supported in said body for providing free rotation of said cable in said body, said receiving means including:

(a) a retainer rotatably supported in said body adjacent said conductor egressing end; and (b) an insert rotatably supported in said retainer, said insert including terminating means for supporting the ends of said conductors for rotation in said body upon rotation of said cable jacket relative to said body.

10. A connector of claim 9 wherein said sealing means includes a cable gland screw attachable to the jacket accommodating end of said body; and a sealing bushing for frictionally surrounding said cable jacket and being positionally confined between said cable gland and said body, the screw attachment of said cable gland causing rotation of said sealing bushing in said body in turn causing said rotation of cable jacket relative to said body.

11. A connector of claim 10 wherein said retainer includes crimped end extents for captivating said insert therein.

12. A connector of claim 11 wherein said insert includes polarized mounting means for providing proper alignment of said insert.

* * * * *